US006810711B2

(12) United States Patent
Mueller

(10) Patent No.: US 6,810,711 B2
(45) Date of Patent: Nov. 2, 2004

(54) PORTABLE CAM AND LEVER ACTUATED CLINCHING, CRIMPING, AND PUNCHING PRESS

(76) Inventor: Tom Mueller, 6501 River Farm Dr., St. Louis, MO (US) 63129

( * ) Notice: Subject to any disclaimer, the term of this patent is extended or adjusted under 35 U.S.C. 154(b) by 105 days.

(21) Appl. No.: 10/271,084

(22) Filed: Oct. 15, 2002

(65) Prior Publication Data

US 2004/0069042 A1 Apr. 15, 2004

(51) Int. Cl.[7] ..... B21J 9/20

(52) U.S. Cl. ..... 72/452.8; 72/452.1; 72/429; 74/110

(58) Field of Search ..... 72/452.1, 452.8, 72/452.9, 429; 74/110

(56) References Cited

U.S. PATENT DOCUMENTS 2,600,860 A * 6/1952 Dupre ..... 72/416
2,865,212 A * 12/1958 Fisher ..... 72/452.8
3,772,907 A * 11/1973 Rider ..... 72/452.8
3,972,218 A * 8/1976 Pawloski ..... 72/452.8
4,617,816 A * 10/1986 Brinkman ..... 72/452.8
5,806,362 A * 9/1998 Dubugnon ..... 72/452.8
5,937,694 A 8/1999 Mueller

OTHER PUBLICATIONS

Norlock Technology Inc.—Brochure for clinching products.
Attexor Inc.—Brochure for clinching product.

* cited by examiner

*Primary Examiner*—David B. Jones
(74) *Attorney, Agent, or Firm*—Kevin L. Klug

(57) ABSTRACT

A portable cam and lever actuated press which utilizes the substantial force available from an air spring to actuate one or more lever arms. The substantial force available from an air spring and the specialty cam system provided allows the device to perform clinching, crimping, punching, stenciling, riveting, stamping, holding, or other operations which would normally be performed with much larger and heavier equipment when the proper punches and dies are installed onto the lever arms. The unit operates pneumatically without the need for hydraulics or hydraulically assisted components.

20 Claims, 6 Drawing Sheets

PORTABLE CAM AND LEVER ACTUATED CLINCHING, CRIMPING, AND PUNCHING PRESS

BACKGROUND OF THE INVENTION

The present invention relates in general to punching, crimping and clinching equipment, and more particularly, to a portable punching, crimping and clinching press which is lever actuated and capable of accepting dies and punches capable of clinching or toggle locking sheet metal and which is preferably pneumatically activated. The present invention represents a unique lightweight press system which performs punching, crimping and clinching of sheet metal or other materials when used with the proper punches and dies.

Clinching is the process of bonding sheet metal materials together with the use of special punches and dies which are manufactured by various manufacturers. The term toggle locking is generically used in the industry and more particularly refers to the use of industry standard Tog-L-Loc® punches and dies of the BTM Corporation of Marysville, Mich. During the clinching process, the punches and dies form an indented portion into overlapping sheet metal material which bulges at the base of the indent in order to bond the materials. No claim is made to the actual clinching or toggle locking punches and dies in this application. A typical system of punches and dies which may be used with the present invention may be found in U.S. Pat. No. 4,459,735 assigned to BTM Corporation. The system of the present art is directed to a press system which holds and actuates said clinching punches and dies and may also serve hole punching, crimping, and stenciling functions when used with alternate punch and die sets.

The art of the present invention allows for the use of any combination of punches and dies which provide for various functions such as hole punching, crimping, stenciling, etc. A unique aspect of this device is the lightweight and portable press system which is capable of using compressed air for operation. The invention utilizes an air stroke actuator which is capable of providing large forces in a small volume and is also capable of flexing in its plain of movement. This flexible plain of movement allows a cam or cam follower on the actuator to follow a cam on a first or second lever arm.

With conventional clinching and punching press systems, ram movement is typically actuated by a hydraulic piston which is either pneumatically pressurized or pressured via a hydraulic pump. This form of actuation typically creates a press which has a bulk and weight which prohibits the press from handheld and portable operation. It further adds to the cost of the press. The few clinching and punching press systems which are strictly pneumatic are of such size and weight that hand held portable operation is not possible. The preferred embodiment of the present art utilizes the substantial force provided by an air stroke actuator to actuate a lever arm which performs clinching, crimping, punching, or other operations.

Accordingly, it is an object of the present invention to provide an improved lever actuated clinching, crimping, and punching press which provides sufficient force for clinching, crimping, punching, and other operations and which is also portable and capable of handheld use.

Another object of the present invention is to provide an improved lever actuated clinching, crimping, and punching press which is capable of pneumatic operation with conventional compressed air and without hydraulic cylinders or hydraulic pumping equipment.

A further object of the present invention is to provide an improved lever actuated clinching, crimping, and punching press which is capable of using various punches and dies to perform various operations on sheet metal or other materials.

A still further object of the present invention is to provide an improved lever actuated clinching, crimping, and punching press which is manufactured from a minimum number of components and which is cost effective.

SUMMARY OF THE INVENTION

To accomplish the foregoing and other objects of this invention there is provided an improved lever actuated clinching, crimping and punching press for use in clinching, crimping, punching, piercing, and stenciling operations and also for holding materials. The system comprises a frame into which is mounted an air stroke actuator, typically a pneumatically operated air spring, having a cam or cam follower attached to a single end, a first lever arm having a first cam roller, a second lever arm having a second cam roller, in addition to the special punches and dies. Alternative embodiments may incorporate the second lever arm as the frame.

In the preferred embodiment, said frame comprises a preferably metallic frame with an opening for mounting said air stroke actuator near a first end and associated cam or cam follower components with said actuator. Preferably a pivot shaft is pivotably mounted through said frame and first and second lever arms. Onto the second ends of the lever arms is mounted the punches or dies. Also, each punch is preferably adjustably mounted within a hole in the second end of each lever arm. This allows for adjustment of the punch extension. In the preferred embodiments, opposite said punch is mounted a die onto the opposing lever arm second end. Each of the cam rollers have a housing which holds each cam roller at the first end. Each of said housings may be integral with one or more of the lever arms. Alternative embodiments may forego use of the cam or cam follower and place air stroke actuator directly between the lever arms.

For clinching operations, the punch typically comprises a ram bushing and stripper which are mounted with and onto an end of said punch. The stripper is typically comprised of a flexible yet durable hollow tube which is able to compress during punch use. The ram bushing has a through-hole through which the punch may protrude and is mounted within said stripper. This arrangement allows the sheet metal to be held between the ram and die by said bushing before the punch performs the clinching operation. The punch, stripper, ram bushing, and die components are uniquely adapted to the clinching, punching, crimping or stenciling operation function and are proprietary to the manufacturer of said components. No claim is made to said components apart from their operation and use with the press of the present invention.

In operation, the user installs the desired punch and die combination and places the piece or pieces of sheet metal or other material between said punch and die. Upon application of compressed air to the air stroke actuator, the cam or cam follower of said air stroke actuator is driven forward between the first and second cam rollers which are mounted with the first ends of the first and second lever arms respectively. The force placed upon and between said cam rollers by the cam or cam follower of the actuator causes the second ends of the lever arms to be forced together. The aforesaid movement of the lever arms causes the aforementioned punch and die to contact and compress the piece or pieces of sheet metal between said punch and die. The extension of the punch into the die is limited by the size of the cam or cam follower attached with said actuator, moment arm length between the lever arm first end and second end relative to the pivot shaft, and the punch adjustment within the mounting hole. The lever arms preferably return to an open rest position when the air pressure to the air stroke actuator is released via the action of the return spring. Preferably the pneumatic pressure is controlled via a pneumatic valve which pressurizes the air stroke actuator when pressed and then vents the actuator when released.

This press and its associated components may be manufactured of many types of materials including but not limited to plastic, composites, and various metals and their alloys as required by the application. In a preferred embodiment, the frame and housings are manufactured from an aluminum alloy, and the ram, rollers, and bolts from steel.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
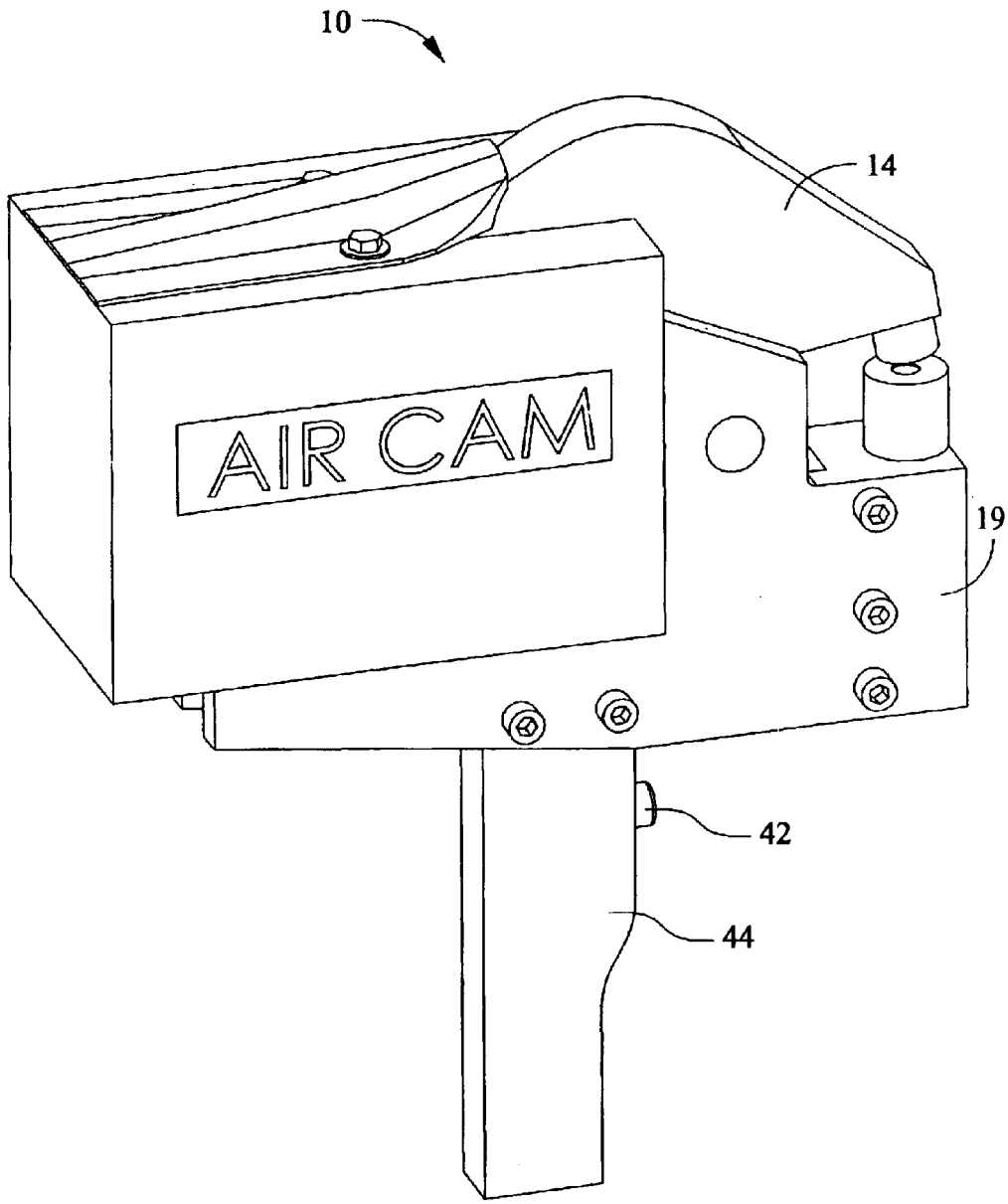
FIG. 1 is a perspective view of a first embodiment of an improved portable cam and lever actuated clinching, crimping, and punching press with the lever arms in an open position and the air stroke actuator un-pressurized and a guard or cover over the actuator and cam rollers.
Figure 2:
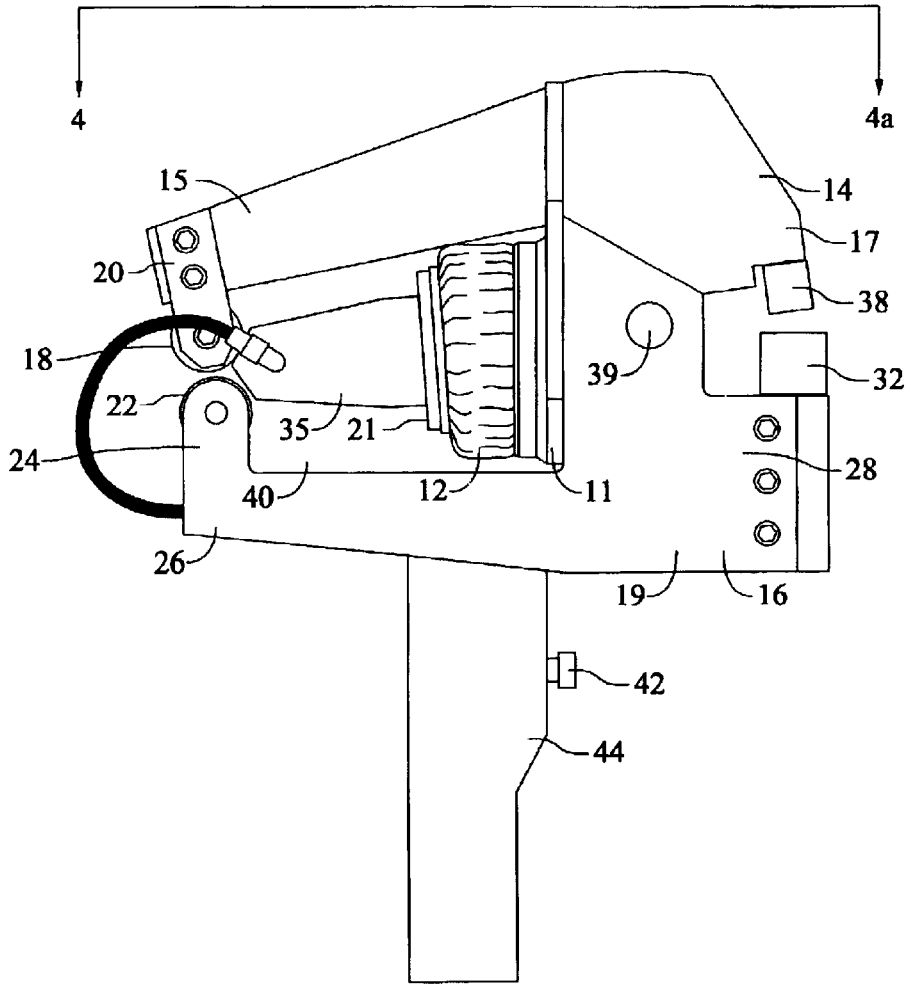
FIG. 2 is a right side plan view of a first embodiment of an improved portable cam and lever actuated clinching, crimping, and punching press with the lever arms in an open position and the air stroke actuator un-pressurized. The right side plan view is substantially symmetric with the left side plan view.
Figure 3:
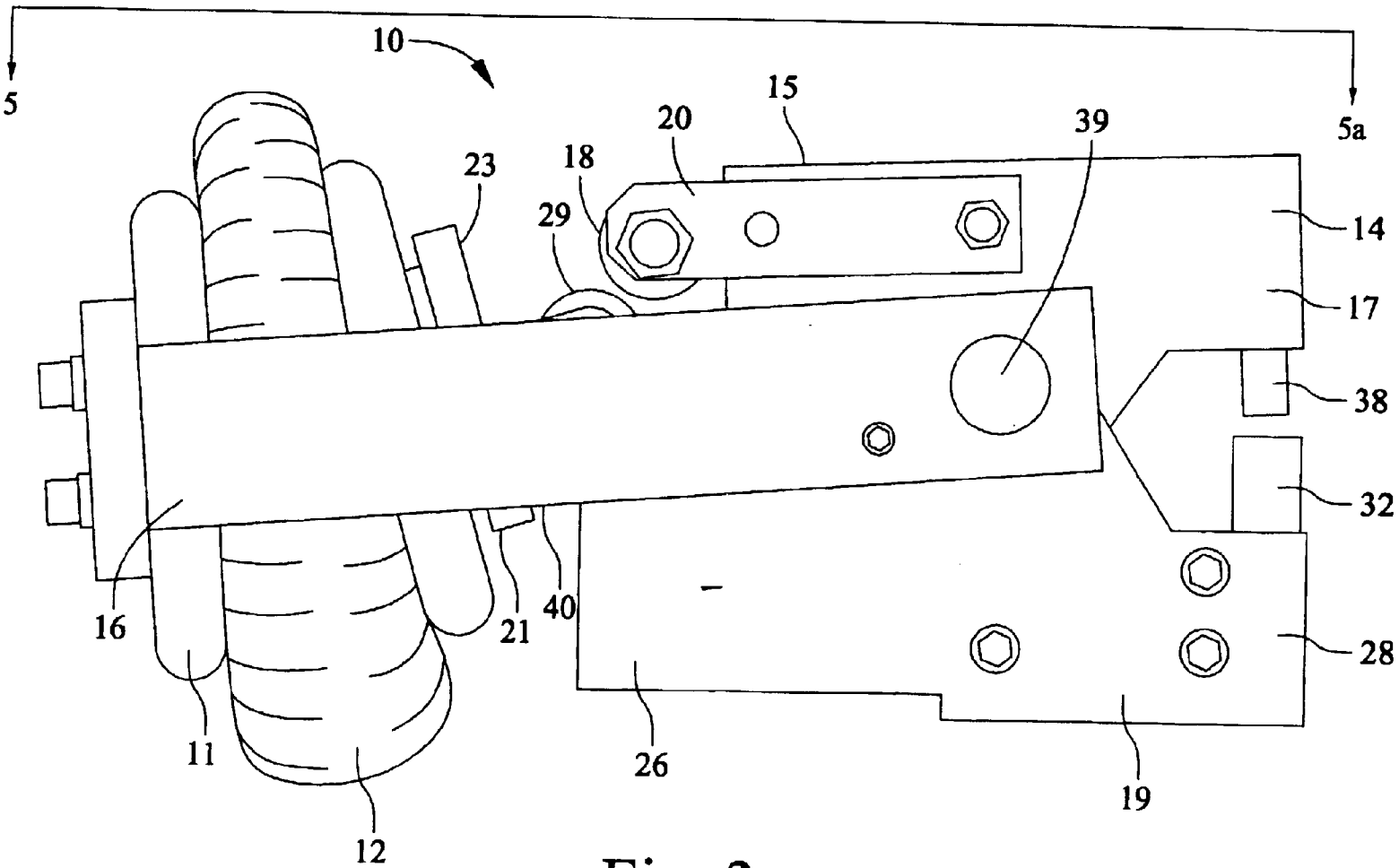
FIG. 3 is a right side plan view of a second embodiment of an improved portable cam and lever actuated clinching, crimping, and punching press with the lever arms in an open position and the air stroke actuator un-pressurized. The right side plan view is substantially symmetric with the left side plan view.
Figure 4:
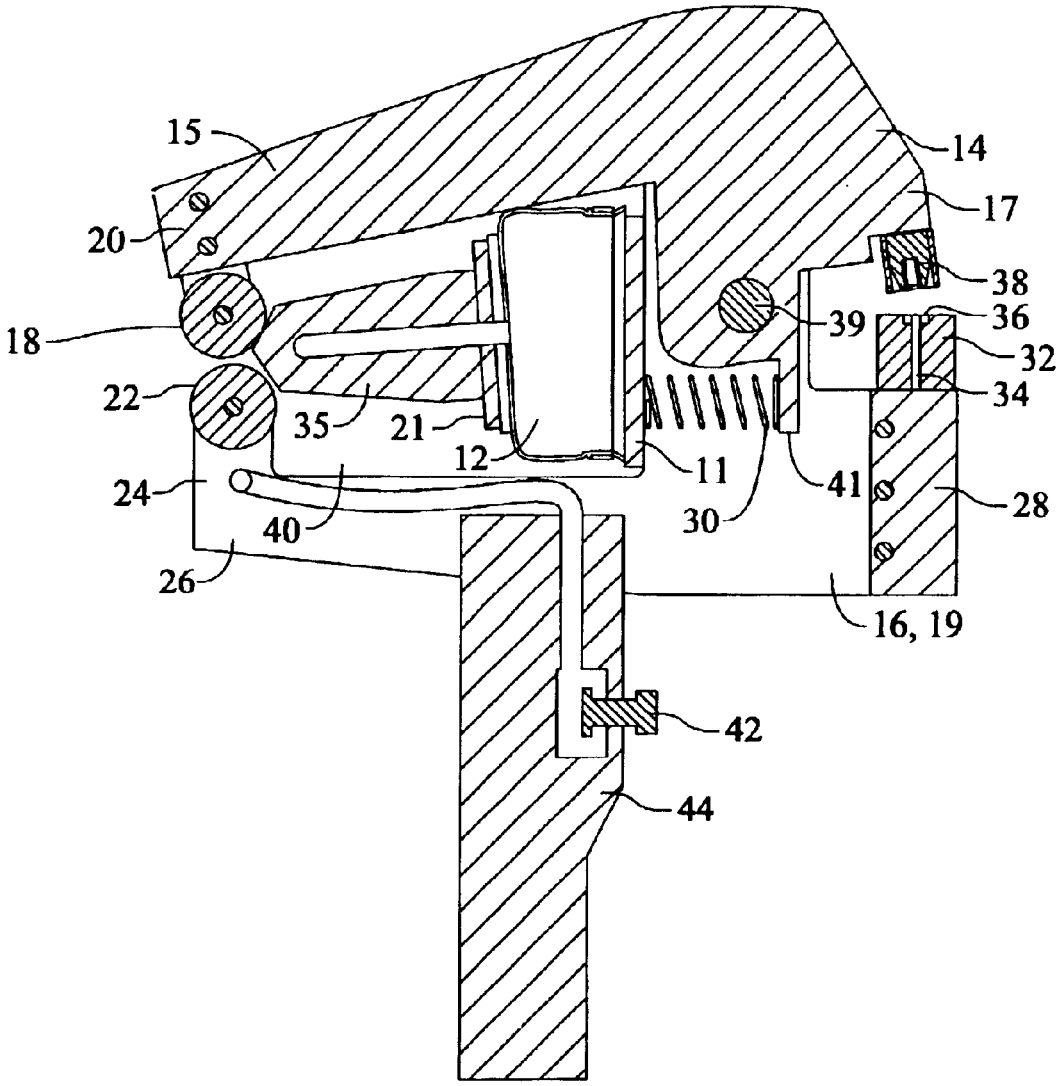
FIG. 4 is a cross sectional view of the first embodiment taken along the central axis of the press and cut line 4–4A of FIG. 2.
Figure 5:
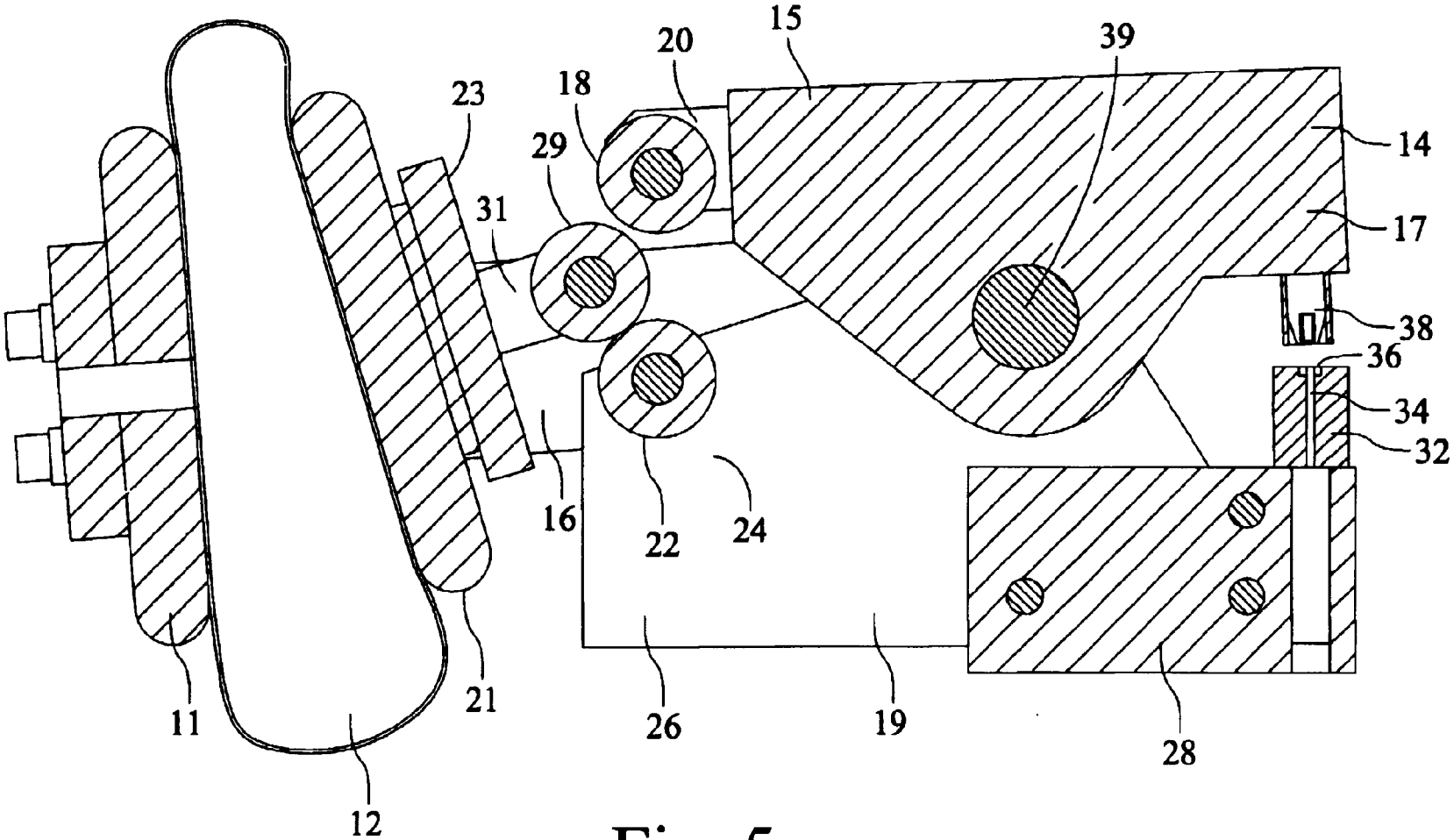
FIG. 5 is a cross sectional view of the second embodiment taken along the central axis of the press and cut line 5–5A of FIG. 3.
Figure 6:
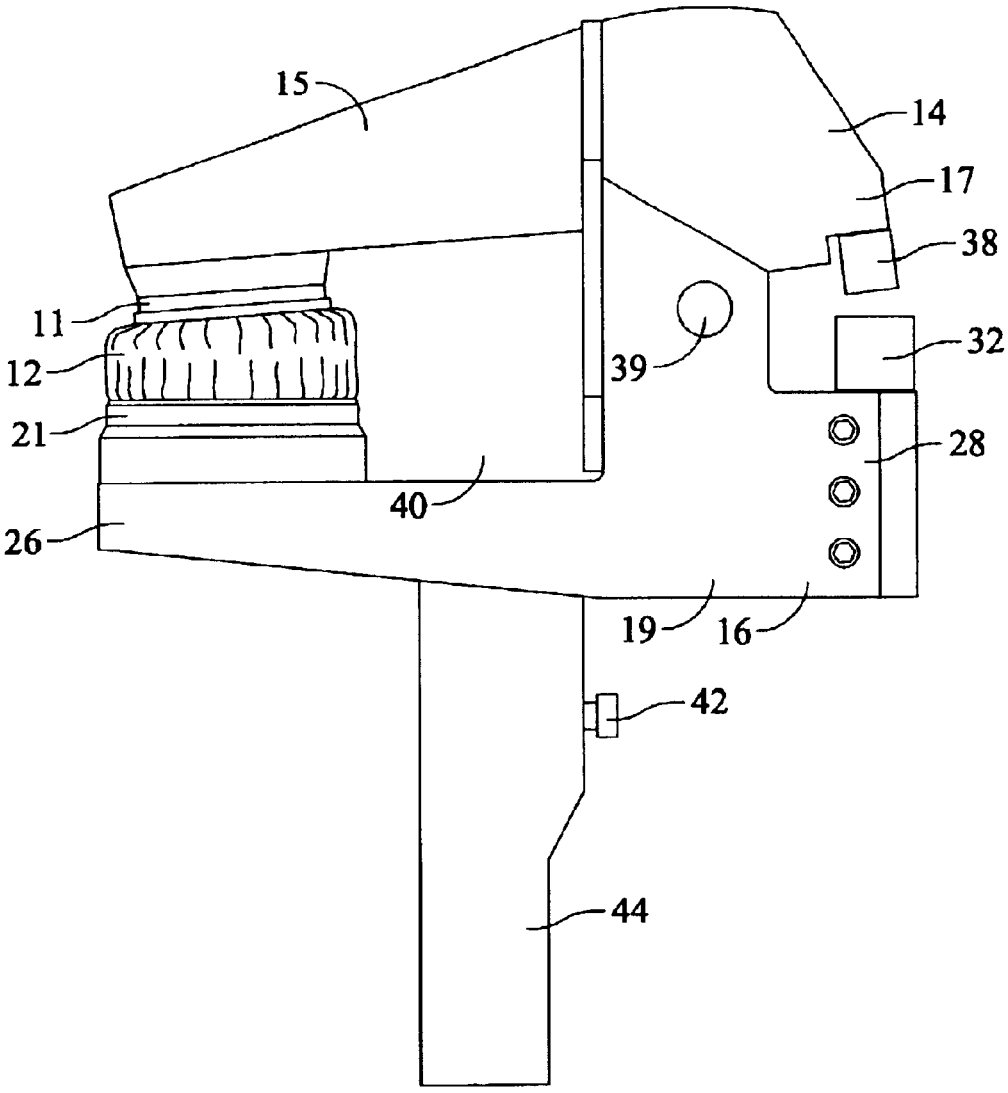
FIG. 6 is a right side plan view of an alternative embodiment of an improved portable cam and lever actuated clinching, crimping, and punching press with the lever arms in an open position and the air stroke actuator un-pressurized. The right side plan view is substantially symmetric with the left side plan view.

Referring now to the drawings, there is shown in FIGS. 1, 2, & 4 a preferred embodiment and in FIGS. 3 & 5 an alternative embodiment of the improved portable cam and lever actuated clinching, crimping, and punching press 10 of the present invention. Subject to the types of punches and dies used, the improved portable cam and lever actuated clinching, crimping, and punching press 10 is particularly adapted for use in clinching, crimping, punching, stenciling, riveting, stamping, piercing, and holding operations of sheet metal or other materials. A unique feature of the present invention is its utilization of the substantial force provided by an air stroke actuator 12 in the form of an air spring in conjunction with the special cam and lever system to provide the required force for the aforementioned operations. All component attachments, when necessary, are achieved with conventional fasteners such as screws, bolts, threads, pins, welds, adhesives or rivets as desired by the manufacturer of the art described.

The drawings show the improved portable cam and lever actuated clinching, crimping, and punching press 10 comprising a frame 16 having an opening 40, a first lever arm 14, a second lever arm 19, a pivot shaft 39, a pneumatic valve 42, and a return spring 30 in a preferred embodiment. Onto said frame 16 and into said opening 40 of said frame 16 is mounted a first end 11 of an air stroke actuator 12, typically an air spring from companies such as Goodyear® or Firestone®. The preferred embodiment further comprises a hand grip 44 with which is mounted a pneumatic valve 42.

As shown in the preferred embodiment, said second lever arm 19 may be utilized as said frame 16 in some embodiments and have limited or no movement. Also, the frame 16 and second lever arm 19 may be integrally mounted together. In further embodiments, the frame 16 may be held in position with the first and second lever arm 14, 19 via the pivot shaft 39 without departing from the scope of the present invention. Also, the displacement direction of the actuator 12 may be reversed in alternative embodiments without departing from the scope of the present invention.

An air spring is a commercial component which typically comprises a rubber bag having an air inlet and mounting plates on each end for attachment. When pressurized, each end displaces relative to the other. Since force is proportional to air pressure multiplied by cross sectional area, the air spring provides significantly more force than a typical air cylinder arrangement due to the substantial cross sectional area of the rubber bag. A further advantage of the air spring is its ability to flex within its plane of movement thereby allowing for misalignments of connected components which mate with other components. In alternative embodiments where lesser punching, crimping, or clinching forces are required, the air stroke actuator 12 may take the form of an air piston and cylinder. Generally said air stroke actuator 12 extension movement is substantially perpendicular to the movement of a first end 15 of the first lever arm 14 and a first end 26 of the second lever arm 19. Alternative embodiments may place said actuator 12 directly between said first end 15 of the first lever arm 14 and the first end 26 of the second lever arm 19. Pressurized air is provided to the actuator 12 via a feed hose from a pneumatic valve 42. A compressed air supply feeds said pneumatic valve 42.

In the preferred embodiment, onto a second end 21 of said air stroke actuator 12 is mounted a cam follower or rolling cam housing 31 which houses an extending cam follower or rolling cam 29. Alternative embodiments may simply utilize a cam 35 with a user desirable profile attached with said second end 21 without departing from the scope of the present art. Within the art, said cam follower or rolling cam 29 may also be referred to as a cam. Said cam follower or rolling cam 29 or cam 35 is positioned within said opening 40 near or between a first cam roller 18 and a second cam roller 22. Each of said rollers or followers 29, 18, 22 is able to rotate within its respective housing 31, 20, 24. Said first cam roller 18 is mounted within its first cam roller housing 20 and said housing 20 is attached to the first end 15 of said first lever arm 14, substantially opposite the second lever arm 19 and the second cam roller 22. If a cam follower 29 is utilized, an actuator stop 23 is typically placed onto and extends from the second end 21 of said actuator 12. This stop 23 prevents the centerline of the cam follower 29 from extending beyond the center line of the cam rollers 18, 22 and thereby binding the device in a closed position. If a cam 35 is utilized instead of a cam follower 31, the profile of the cam 35 is chosen to minimize the possibility of device binding in a closed position.

Said second cam roller 22 is mounted within the second cam roller housing 24 and said housing 24 is mounted onto or near a first end 26 of said second lever arm 19. Alternative embodiments may forego use of the first and second cam rollers 18, 22, provided the alternative bearing surfaces allow the cam follower 29 or the cam 35 to separate and impart force to the first and second lever arms 14, 19. Within the art, said cam rollers 18, 22 may also be referred to as bearing surfaces.

In a preferred embodiment, a return spring 30 is engaged with or mounted between said first lever arm 14 and said second lever arm 19. The preferred embodiment utilizes a spring arm 41 on said first lever arm 14 which compressively sandwiches the return spring 30 between said arm 41 and said second lever arm 19 or frame 16. As aforesaid, the second lever arm 19 may function as the frame 16 and provide mounting for the air stroke actuator 12 in some embodiments. The return spring 30 provides for second end 28, 17 lever arm 14, 19 opening when the air pressure is released from the air stroke actuator 12. Alternative embodiments may place said return spring 30 at a plurality of locations to achieve the aforementioned benefits. Alternative embodiments may also utilize springs in tension, or utilize torsion or leaf springs to achieve the aforementioned benefits.

In a preferred embodiment, onto said second lever arm 19 near a second end 28 is placed the desired punch 34 and opposite said punch on said first lever arm 14 near a second end 17 is placed the desired die 38. Should the operation require, the die 38 and punch 34 may be switched opposite in placement. Should the user desire to perform a clinching operation, a stripper 32 and a ram bushing 36 would be provided around said punch 34. The present art utilizes punches 34 and dies 38 which are provided by third parties and does not claim the art of said punches 34 and dies 38. Nevertheless, those skilled in the art will recognize that various modifications to the lever arms 19, 14 may be required in order to use the desired punch and die combination. This may require drilling, threading and other machining operations to the lever arms 19, 14.

In the preferred embodiment, the first lever arm 14 pivotably connects with the second lever arm 19 via a pivot shaft 19. In the preferred embodiment said shaft 19 is simply a pin placed through holes in said lever arms 14, 19. Alternative embodiments may utilize bolts, screws, tubes, rivets, dowels, or other pivotal connecting devices in place of said pivot shaft 19. Also in a preferred embodiment, said first lever arm 14 fits within a cavity or channel within said second lever arm 19. Alternative embodiments may pivotably attach and fit the two arms 14, 19 in a plurality of ways, including but not limited to extension arms, plates, cavities, or hinges which allow the two arms 14, 19 to pivot in alignment.

The size of said cam follower or rolling cam 29 or cam 35 of said air stroke actuator 12 controls the relative displacement of said first ends 15, 26 of the lever arms 14, 19. Since the lever arms 14, 19 are pivotably connected with the pivot shaft 39, the force placed upon said rollers 18, 22 by the cam follower or rolling cam 29 or cam 35 driving between said rollers 18, 22 causes the second ends 17, 28 to be forced toward each other. This causes the aforementioned punch 34 to contact and compress the piece or pieces of sheet metal between said punch 34 and die 38. The relative movement of the punch 34 and die 38 are controlled by the relative moment arms between the punch 34, die 38, first cam roller 18, second cam roller 22 and the pivot shaft 39. That is, if $L_{11}$ is the moment distance from the first cam roller 18 axis to the pivot shaft 39 axis, and $L_{12}$ is the moment distance from the die 38 central axis to the pivot shaft 39 axis, and $L_{21}$ is the moment distance from the second cam roller 22 axis to the pivot shaft 39 axis, and $L_{22}$ is the moment distance from the punch 34 central axis to the pivot shaft 39 axis, and the cam follower 29 or cam 35 displaces the first ends 15, 26, by an amount $d_1$, the displacement or movement of the punch 34 and die 38, $d_2$, is defined as:

$$d_2=d_1*L_{12}/L_{11}$$

provided that $L_{11}$ and $L_{21}$ are substantially equal and $L_{12}$ and $L_{22}$ are substantially equal. Likewise, the force at and between the second end may be related to the force at and between the first end as:

$$F_2=F_1*L_{11}/L_{12}$$

Thus, the first and second lever arms 14, 19 are able to provide a force or displacement multiplier for the substantial force available from the actuator 12. Since $L_{12}$ is generally shorter than $L_{11}$ in the preferred embodiment, the present invention provides a force multiplication of that portion of the actuator 12 force which the cam follower 31 or cam 35 places upon the first ends 15, 26. The position of the punch 34 relative to the die 38 upon full pressurization and displacement of the actuator 12 is further controlled by the length of extension of said punch 34 or possibly said die 38 from said second end 17, 28.

In the preferred embodiment when utilizing a cam 35, the cam 35 has a short first section with a steep or accelerated profile to move the die 38 and punch 34 at the second ends 17, 28 near or onto the sheet metal. This short profile limits the force transfer from the actuator 12 to the lever arms 14, 19. The cam 35 thereafter has an elongated second section with a gradual or lower profile which provides less second end 17, 28 displacement but more force to perform the clinching, crimping, punching or other operations. Alternative embodiments may utilize cams 35 with a plurality of profiles without departing from the scope and spirit of the present invention.

The alternative embodiment which does not utilize a cam 35, cam follower 29, or cam rollers 18, 22 simply attaches the air stroke actuator 12 first end 11 with or near the first end 15 of the first lever arm 14 and the air stroke actuator 12 second end 21 with or near the first end 26 of the second ever arm 19. That is, as the air stroke actuator 12 attaches with the frame 16 or second lever arm 19 in a preferred embodiment, it may attach with the first end 15 of the first lever arm 14 in an alternative embodiment. Also, as the air stroke actuator 12 attaches with the cam 35 or cam follower 29 in a preferred embodiment, it may also attach with the first end 26 of the second lever arm 19. Although, not providing the force or positioning control advantages of the cam system, the aforesaid alternative embodiment does provide the clinching, crimping, punching, and other operations of the present art.

In operation, the user installs the desired punch 34 and die 38 combination as aforesaid and places a piece or pieces of sheet metal between said punch 34 and die 38. The user then activates a pneumatic valve 42 to pressurize the actuator 12. Upon application of compressed air to the air stroke actuator 12, the cam follower or rolling cam 29 or cam 35 of said air stroke actuator 12 is driven forward between said first cam roller 18 and said second cam roller 22. Upon pressurization, the punch 34 and die 38 approach and contact the surfaces of the sheet metal to perform the operation. Upon deactivation of the valve 42, the actuator 12 is vented to atmosphere and depressurized. Upon depressurization of the actuator 12, the return spring 30 returns the lever arms 14, 19 to the original opened and rested position, whereby the material there between may be removed.

As described, the art of the present invention is shown with a clinching die 38 and its associated punch 34, stripper 32, and ram bushing 36 in place. The clinching process bonds two pieces of sheet metal together by forcing a portion of the sheet metal defined by the diameter of the punch 34 into a die 38 having an inverted taper. The die 38 expands outwardly when the punch 34 retracts, thereby allowing for removal of the sheet metal. The art of the present invention is drawn to the press 10 alone and the combination of the press 10 with the clinching, crimping, punching, stenciling, or holding punches and dies of the user's choice but no claim is made to the punches and dies apart from the press.

From the foregoing description, those skilled in the art will appreciate that all objects of the present invention are realized. An improved press for clinching, crimping, punching, stenciling, riveting, stamping, and holding operations is shown which is particularly adapted for operation with sheet metal. The press of this invention is able to provide the required force for such operations without the use of hydraulics or exceptionally large and heavy equipment.

Having described the invention in detail, those skilled in the art will appreciate that modifications may be made to the invention without departing from its spirit. Therefore, it is not intended that the scope of the invention be limited to the specific embodiments illustrated and described. Rather it is intended that the scope of this invention be determined by the appended claims and their equivalents.

What is claimed is:

1. A press comprising:

a first lever arm and a second lever arm, each of said lever arms having a first end and a second end; and said first lever arm and second lever arm pivotably attached whereby said first end of said first lever arm pivotably moves relative to the first end of said second lever arm and said second end of said first lever arm pivotably moves relative to the second end of said second lever arm; and an air stroke actuator in the form of an air spring capable of flexing in its plane of movement having a first end and a second end, said first end of said air stroke actuator extending away from said second end of said air stroke actuator when said actuator is pressurized, and said first end of said air stroke actuator mounted with one of said lever arms, and said second end of said air stroke actuator having a cam extending therefrom;

each of said first ends of said lever arms having a bearing surface positioned to allow said cam to contact said bearing surfaces and separate and impart force to said first and second lever arms when said air stroke actuator is pressurized thereby pivotably moving said second ends closer.

2. The press as set forth in claim 1 whereby:

said first lever arm and second lever arm are pivotably attached with a pivot shaft located between said first and second ends of said lever arms.

3. The press as set forth in claim 1 whereby:

said cam extending from said second end of said air stroke actuator comprises a cam follower having a rolling cam.

4. The press as set forth in claim 1 whereby:

one or more of said bearing surfaces on said first ends of said lever arms comprises a cam roller.

5. The press as set forth in claim 1 further comprising:

a die attached with one of said second ends; and a punch attached with one of said second ends substantially opposite said die.

6. The press as set forth in claim 1 further comprising:

a return spring substantially connected with said first lever arm and said second lever arm, whereby said second ends of said lever arms move apart via the force of said spring when said air stroke actuator is de-pressurized.

7. The press as set forth in claim 1 whereby:

said first end of said air stroke actuator is mounted with said lever arms via a frame attached with said second lever arm.

8. The press as set forth in claim 1 further comprising:

a pneumatic valve attached with a hand grip, whereby when said valve is pressed said air stroke actuator is pressurized.

9. A press comprising:

a frame having an opening; and an air stroke actuator in the form of an air spring capable of flexing in its plane of movement having a first end and a second end, said first end attached to said frame within said opening and said second end attached to a cam; and a first lever arm and a second lever arm, each of said lever arms having a first end and a second end, said first lever arm pivotably connected with said second lever arm and said frame connected with one of said lever arms; and a first cam roller housing having a first cam roller attached near said first end of said first lever arm and a second cam roller housing having a second cam roller attached near said first end of said second lever arm, each of said cam rollers extending from said housings substantially toward the other cam roller, said air stroke actuator positioned such that said cam is capable of driving between said first cam roller and said second cam roller when said air stroke actuator is pressurized thereby forcing said first ends of said lever arms apart and forcing said second ends of said lever arms closer.

10. The press as set forth in claim 9 whereby:

said first lever arm and second lever arm are pivotably attached with a pivot shaft located between said first and second ends of said lever arms.

11. The press set forth in claim 9 whereby:

said cam extending from said second end of said air stroke actuator comprises a cam follower having a rolling cam.

12. The press as set forth in claim 9 further comprising:

a die attached with one of said second ends; and a punch attached with one of said second ends substantially opposite said die.

13. The press as set forth in claim 9 further comprising:

a return spring substantially engaged with said first lever arm and said second lever arm, whereby said second ends of said lever arms move apart via the force of said spring when said air stroke actuator is de-pressurized.

14. A method for pneumatically clinching, crimping, punching, stenciling, riveting, stamping, piercing, or holding sheet material, the steps comprising:

pivotably attaching a first and a second lever arm, each having a first and a second end; and forming a bearing surface near each of said first ends of said lever arms; and forming and mounting a cam onto a second end of an air stroke actuator in the form of an air spring capable of flexing in its plane of movement; and mounting a first end of said air stroke actuator substantially with one of said lever arms whereby said cam is able to extend between said bearing surfaces when said air stroke actuator is pressurized; and forming a die with one of said second ends of said lever arms; and forming a punch with one of said second ends of said lever arms opposite said die; and placing one or more pieces of a sheet material between said die and said punch; and pressurizing said air stroke actuator, whereby said cam separates said first ends of said lever arms and thereby forces said second ends of said lever arms closer and said die and punch into forceable contact with said sheet material; and de-pressurizing said air stroke actuator, whereby said die and punch release said sheet material.

15. The method for pneumatically clinching, crimping, punching, stenciling, riveting, stamping, piercing, or holding sheet material, as set forth in claim 14, whereby:

said bearing surface is formed into one or more cam rollers.

16. The method for pneumatically clinching, crimping, punching, stenciling, riveting, stamping, piercing, or holding sheet material, as set forth in claim 14, the steps further comprising:

installing a return spring substantially in engagement with said first lever arm and said second lever arm, whereby said die and punch release said sheet material via the force of said spring when said air stroke actuator is de-pressurized.

17. A press comprising:

a first lever arm and a second lever arm, each of said lever arms having a first end and a second end; and said first lever arm and second lever arm pivotably attached whereby said first end of said first lever arm pivotably moves relative to the first end of said second lever arm and said second end of said first lever arm pivotably moves relative to the second end of said second lever arm; and an air stroke actuator in the form of an air spring capable of flexing in its plane of movement having a first end and a second end, said first end of said air stroke actuator extending away from said second end of said air stroke actuator when said actuator is pressurized, said first end of said air stroke actuator mounted onto the first lever arm near the first end of the first lever arm and the air stroke actuator second end mounted onto the second lever arm near the first end of the second lever arm, whereby said air stroke actuator extends and imparts force to said first and second lever arms when said air stroke actuator is pressurized thereby pivotably moving said second ends closer.

18. The press as set forth in claim 17 further comprising:

a die attached with one of said second ends; and a punch attached with one of said second ends substantially opposite said die.

19. The press as set forth in claim 17 further comprising:

a return spring substantially connected with said first lever arm and said second lever arm, whereby said second ends of said lever arms move apart via the force of said spring when said air stroke actuator is de-pressurized.

20. A method for pneumatically clinching, crimping, punching, stenciling, riveting, stamping, piercing, or holding sheet material, the steps comprising:

pivotably attaching a first and a second lever arm, each having a first and a second end; and mounting an air stroke actuator in the form of an air spring capable of flexing in its plane of movement with said first and second lever arms near said first ends whereby said actuator imparts a force to said first and second lever arms when said air stroke actuator is pressurized; and forming a die with one of said second ends of said lever arms; and forming a punch with one of said second ends of said lever arms opposite said die; and placing one or more pieces of a sheet material between said die and said punch; and pressurizing said air stroke actuator, whereby said air stroke actuator separates said first ends of said lever arms and thereby forces said second ends of said lever arms closer and said die and punch into forceable contact with said sheet material; and de-pressurizing said air stroke actuator, whereby said die and punch release said sheet material.

* * * * *